United States Patent [19]

Trapani et al.

[11] Patent Number: 5,014,916

[45] Date of Patent: May 14, 1991

[54] ANGULAR GAS CAP FOR THERMAL SPRAY GUN

[75] Inventors: Richard D. Trapani, Flushing; Martin E. Hacker, Lake Ronkonkoma; Melvyn E. Turner, Wantagh; Ronald Taylor, Fresh Meadows; Anthony J. Rotolico, Hauppauge, all of N.Y.

[73] Assignee: The Perkin-Elmer Corporation, Norwalk, Conn.

[21] Appl. No.: 514,648

[22] Filed: Apr. 25, 1990

[51] Int. Cl.[5] ..... B05B 1/24

[52] U.S. Cl. ..... 239/85; 239/79; 239/290

[58] Field of Search ..... 239/79–85, 239/290, 299, 434.5

[56] References Cited

U.S. PATENT DOCUMENTS

| | | | |
|---|---|---|---|
| 3,056,558 | 10/1962 | Gilliland et al. | 239/83 |
| 3,122,321 | 2/1964 | Wilson et al. | 239/84 |
| 3,136,484 | 6/1964 | Dittrich | 239/79 |
| 3,171,599 | 3/1965 | Rotolico | 239/85 |
| 3,707,615 | 12/1972 | Rotolico et al. | 219/121 P |
| 4,865,252 | 9/1989 | Rotolico et al. | 239/8 |

FOREIGN PATENT DOCUMENTS

| | | | |
|---|---|---|---|
| 0271032 | 6/1988 | European Pat. Off. | 239/79 |
| 1084684 | 1/1955 | France | 239/83 |

*Primary Examiner*—Andres Kashnikow
*Assistant Examiner*—Karen B. Merritt
*Attorney, Agent, or Firm*—H. S. Ingham; E. T. Grimes

[57] ABSTRACT

A gas cap for a thermal spray gun has a passage therethrough including an entrance channel, an exit channel, and an intermediate channel connecting between the entrance and exit channels. The entrance channel is cylindrical on an entrance axis, and the exit channel is convergingly conical on an exit axis oriented at 45° to the entrance axis. The intermediate channel is symmetrical to the plane of the entrance and exit axes and has a near portion and a far portion. The near portion is semicylindrical about the entrance axis, and the far portion is semicylindrical about a far axis segment lying in the plane. That segment is offset from the entrance axis away from the exit end of the gas cap, and is oriented at 14° to the entrance axis, the three axes intersecting at a common point.

21 Claims, 3 Drawing Sheets

| FIG. 1a |
| --- |
| FIG. 1b |

ANGULAR GAS CAP FOR THERMAL SPRAY GUN

This invention relates to thermal spray guns and particularly to a gas cap for such a gun to deflect the spray stream at an angle.

BACKGROUND OF THE INVENTION

Thermal spraying, also known as flame spraying, involves the heat softening of a heat fusible material such as metal or ceramic, and propelling the softened material in particulate form against a surface which is to be coated. The heated particles strike the surface where they are quenched and bonded thereto. In one type of thermal spray gun, the heat fusible material is supplied to the gun in powder form in a carrier gas. Such powders are typically comprised of small particles, e.g., between 100 mesh U. S. Standard screen size (149 microns) and about 2 microns. Alternatively, wire is used as the feed material.

A thermal spray gun normally utilizes a combustion or plasma flame to produce the heat for melting of the powder particles. Other heating means may be used as well, such as electric arcs, resistance heaters or induction heaters, and these may be used alone or in combination with other forms of heaters.

A particular challenge is spraying on the inside surfaces of confined areas such as in holes, pipes and the like. The guns normally spray forwardly with a spray distance of at least several centimeters, and an ordinary spray gun is at least 15 cm long, restricting the ability to spray sideways in a small hole. In the past various adaptations have been made for coating inside surfaces. In the simplest case only the nozzle is turned sideways on the end of an extension, as disclosed for a powder flame spray gun in U.S. Pat. No. 3,171,599 (Rotolico). This is not possible for a wire spray gun since the extension must accommodate the relatively stiff wire. Therefore other deflectors were devised, including blasting the melting wire tip with air from sideways (U.S. Pat. No. 3,136,484, Dittrich), curving the air cap (U.S. Pat. No. 3,122,321, Wilson et al), and a combination of these (U.S. Pat. No. 3,056,558, Gilliland et al). In a plasma spray gun a double angle nozzle has been used (U.S. Pat. No. 3,707,615, Rotolico et al).

None of the aforementioned approaches has been adaptable to provide an extension for a recently developed high velocity thermal spray gun of the type disclosed in U.S. Pat. No. 4,865,252 of the present assignee. The complexity of the high velocity gas head is not readily miniaturizable to turn sideways, the very high velocity flame spray stream cannot be deflected sufficiently, and a conventional curved gas cap is susceptible of erosion and powder buildup.

SUMMARY OF THE INVENTION

Therefore, an object of the invention is to provide a novel gas cap for a thermal spray gun, particularly a very high velocity type of gun, for spraying at an angle into confined areas. Another object is to provide an improved thermal spray gun for spraying into confined areas.

The foregoing and other objects are achieved by an angular gas cap for a thermal spray gun, comprising a gas cap member having a passage extending therethrough with an inlet end and an outlet end, the passage being receptive of a spray stream of a thermal spray burner head from the inlet end. The passage includes an entrance channel extending from the inlet end, an exit channel extending to the outlet end, and an intermediate channel connecting between the entrance and exit channels. The entrance channel is symmetrical on an entrance axis and the exit channel is symmetrical on an exit axis oriented at a selected angle to the entrance axis greater than zero and preferably between about 30° and 60°, with the entrance axis and the exit axis defining a plane.

The intermediate channel is symmetrical to the plane and has a near portion and a far portion. The near portion is generally semicylindrical about the entrance axis. The far portion is generally semicylindrical about a far axis segment lying in the plane. The far axis segment is offset from the entrance axis in a direction away from the outlet end and oriented at an intermediate angle to the entrance axis between zero and the selected angle, preferably with the three axes intersecting at a common point. The far portion has a wall segment distal from the near axis and substantially connecting with adjacent wall segments of the entrance and exit channels.

In preferred embodiments the entrance channel is generally cylindrical with an entrance radius, and the exit channel is convergingly conical toward the outlet end which has an exit radius with a value less than the entrance radius. The near portion of the intermediate channel has a near radius with a value between the entrance radius and the exit radius, and the far portion has a far radius with a value between the near radius and the exit radius. The intermediate channel further has a conically convergent portion symmetrical on the entrance axis connecting from the entrance channel to the near and far portions exclusive of the distal wall segment.

The objects are also achieved with a thermal spray gun incorporating the above-described gas cap. In a preferred aspect the thermal spray gun is a very high velocity type of gun.

DETAILED DESCRIPTION OF THE INVENTION

Figures 1, 1A:
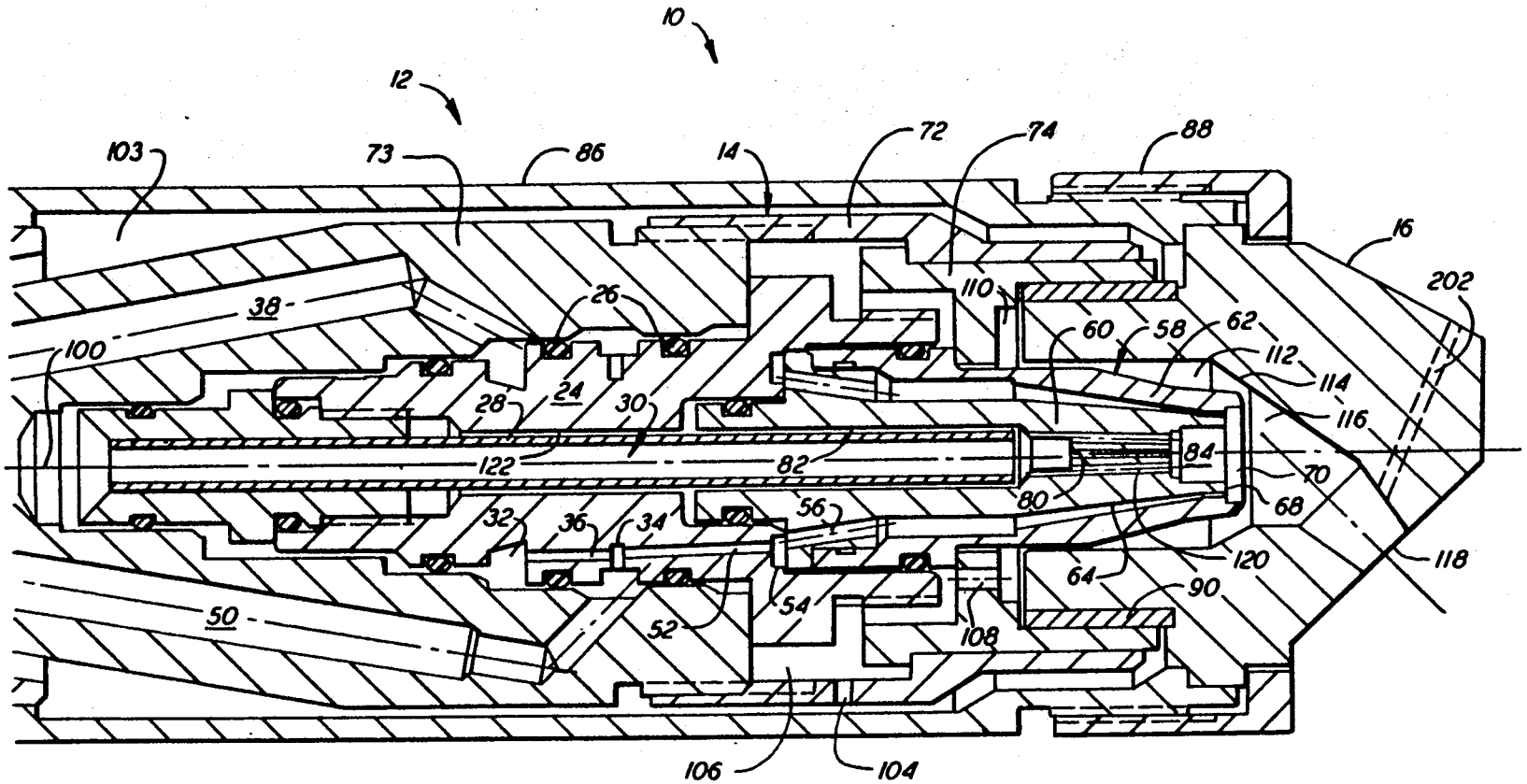
FIG. 1 shows the relationship between FIG. 1*a* and FIG. 1*b*.
FIG. 1*a* and FIG. 1*b* are downstream and upstream, respectively, longitudinal sections of a thermal spray gun incorporating the invention.
Figure 1B:
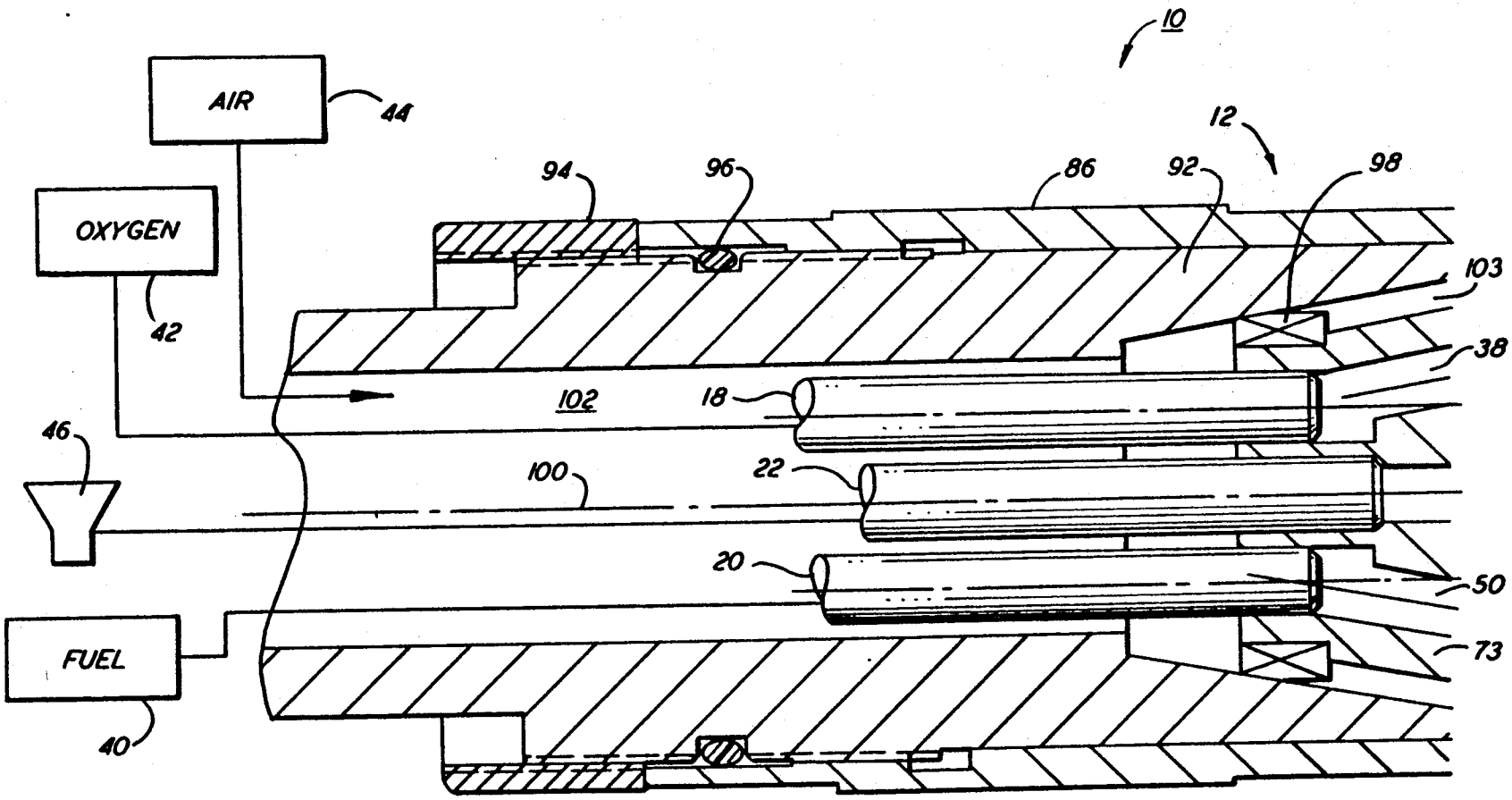

A thermal spray apparatus according to the present invention is illustrated in FIG. 1. A thermal spray gun 10 basically comprises a rear gun body and an extension 12 with a burner head 14. The rear body (not shown) includes valving and passages for supplying gases. The burner head is advantageously of the type utilized for very high velocity spray, as disclosed in the aforementioned U.S. Pat. No. 4,865,252. A gas cap 16 is mounted on the burner head. Fuel, oxygen and air are supplied from respective sources 40,42,44 to the burner head in the conventional manner as taught in aforementioned U.S. Pat. No. 3,122,321.

The passages for the fuel and oxygen connect to respective rigid pipes 18,20 extending from the rear gun body. A third pipe 22 for a carrier gas containing powder from a feeder 46 extends similarly, so that the three pipes are held in parallel adjacently to each other. Powder feeder 46 is of the conventional or desired type but must be capable of delivering the carrier gas at high enough pressure to carry the powder through back pressures in the nozzle and gas cap. Alternatively the powder/carrier pipe 22 may instead be a wire guide for wire to be thermal sprayed in place of powder. These pipes also function to rigidly support the burner head 14 spaced from the rear body by a distance representing a chosen length for the gun extension, ranging from 15 cm to one meter or more.

In the burner head 14 of the present example, a cylindrical siphon plug 24 is fitted in a corresponding bore, and a plurality of O-rings 26 thereon maintain a gas-tight seal. The siphon plug is provided with a central tube 28 having a passage 30 receptive of the powder/-carrier flow from tube 22. (The siphon plug may alternately have a central passageway to accommodate the feeding of wire.) The siphon plug further has therein an annular groove 32 and a further annular groove 34 with a plurality of interconnecting passages 36 (one shown). Oxygen is passed from source 42 through tube 18 into a passage 38 from whence it flows into groove 32 and through passages 36. A similar arrangement is provided to pass fuel gas from source 40 through tube 20 and a passage 50 into groove 34, mix with the oxygen, and pass as a combustible mixture through further passages 52 aligned with passages 36 into an annular groove 54. Annular groove 54 feeds the mixture into a plurality of passages 56 in the rear section of a nozzle member 58.

Nozzle member 58 is conveniently constructed of a tubular inner portion 60 and a tubular outer portion 62. (As used herein and in the claims, "inner" denotes toward the axis and "outer" denotes away from the axis. Also "forward" or "forwardly" denotes toward the spraying end of the gun; "rear", "rearward" or "rearwardly" denotes the opposite.) Between the inner and outer portions is outer annular orifice 64 for injecting the annular flow of the combustible mixture into the combustion chamber. This annular orifice may instead be a ring of equally spaced orifices. The combustible mixture flowing from groove 54 thus passes through the orifice 64 to produce an annular flow from the forward nozzle face 68 which is ignited in an end recess 70.

A nozzle nut 72 and a bushing 74 hold nozzle 58 and siphon plug 24 on a gas head 73. The burner nozzle 58 extends into gas cap 16 which extends forwardly from the nozzle. The nozzle member is also provided with an axial bore 82, for powder tube 28. A powder orifice 80 in the nozzle extends forwardly from tube passage 30 into a further recess 84 in the nozzle face 68.

The gas cap 16 is coaxially attached to a tubular housing 86 gas with a threaded retainer ring 88 which provides a gas-tight seal joint. The housing extends rearwardly over the gas head 14. The gas cap and forward end of the housing are mounted on the gas head by a forward bearing 90 which allows rotation of the gas cap/housing assembly on the gas head if such is desired in utilizing the extension. The bearing is advantageously a bronze bushing press fitted on the rearward outside of the gas cap, and slidingly fitted into the bushing 74 of hardened steel that also acts as the nozzle retainer.

Rearwardly the housing is threaded onto a rotatable tubular member 92 which effectively constitutes a rearward extension of the housing. A locking collar 94 is threaded on the tubular member abutting the housing 86 to lock the housing in place on the member. An O-ring seal 96 is disposed between the housing and the member.

A rear bearing 98 such as a needle bearing supports the tubular member 92 and consequently the housing 86 rotatingly on the gas head 73, in accurate alignment with the main axis 100. The tubular member extends back to the rear body where it is fitted into a hole in the body, for example with a double O-ring lubricated to effect a rotatably sliding seal.

A conventional drive means (not shown) for rotating the housing on the entrance axis may include gear teeth or a drive pulley on the perifery of the tubular member. An electrical motor mounted on the rear body is geared down with a similarly mounted gear box from which a drive shaft extends. A drive gear or pulley on the shaft engages the gear teeth or belt to rotate the assembly of the tubular member, housing and gas cap, for example at 200 rpm.

Air or other non-combustible gas is passed under pressure from source 44 through connecting regions 102 and 103 within member 92 and housing 86, and through passages 104 to a space 106 in the interior of retainer ring 72 in region 102. Bypass holes bypass the bearing 98 to communicate the portions of regions 102,103. Spaces left between the pipes and the tubular member, and between the housing and the burner head, provide channeling for air flowing from the air passage from the valve. A further set of holes 108 (one shown) in the steel bushing 74 then directs the air to a forward annular chamber 110 communicating with the gas cap. The air flows under pressure into gas cap 16 outside of nozzle 58 so that the air may flow as an outer sheath from an annular slot 112 between the outer surface of nozzle 58 and an inwardly facing wall 114. Forward of the nozzle the wall defines a combustion chamber 116 into which slot 112 exits. The flow continues through chamber 116 as an outer flow mixing with the inner flows, and out of the outlet end 118 in gas cap 16. Chamber 116 is bounded at its opposite, rearward end by face 68 of nozzle 58.

Preferably the inner portion 60 of the nozzle member has therein a plurality of parallel inner orifices 120 which provide for an annular inner sheath flow of gas, such as air, about the central powder feed issuing from orifice 80 of the nozzle. This inner sheath of air contributes significantly to reducing any tendency of buildup of powder material on wall 114. The sheath air is conveniently tapped from region 102, via ducts (not shown) in the gas head 73 into an annular space 122 adjacent tube 28. The inner sheath air flow should generally be between 1% and 10% of the outer sheath flow rate.

Figure 2:
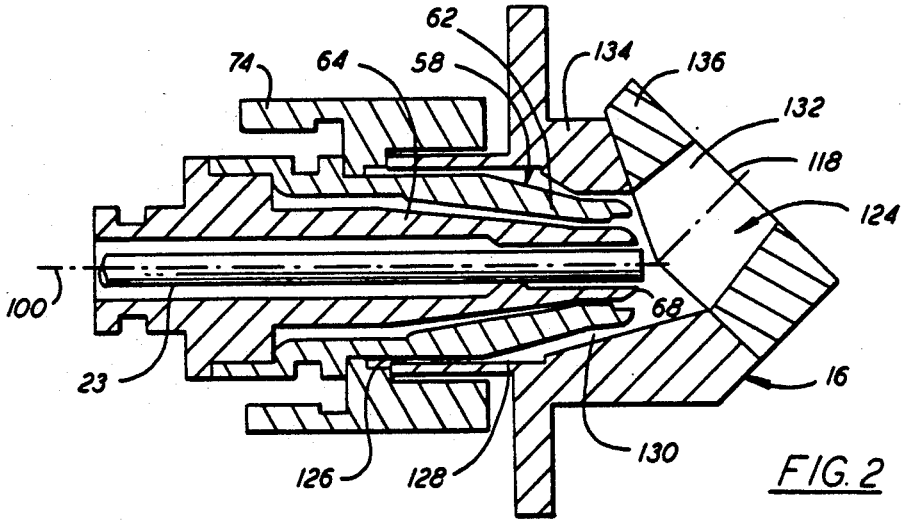
FIG. 2 is a longitudinal section of an assembly including a gas cap according to the invention.

FIG. 2 shows a 45° gas cap in more detail, assembled on a nozzle having an alternative configuration without recesses in the face 68. The gas cap member 16 according to the invention is an angular gas cap with an angularly curved passage 124 extending therethrough, the cap having an inlet end 126 and outlet end 118. As explained above the passage 124 is receptive from the inlet end of a spray stream of the thermal spray burner head 14. The passage is formed of an entrance channel 128 extending from the inlet end, an exit channel 132 extending to the outlet end, and an intermediate channel 130 connecting between the entrance and exit channels.

Figure 3:
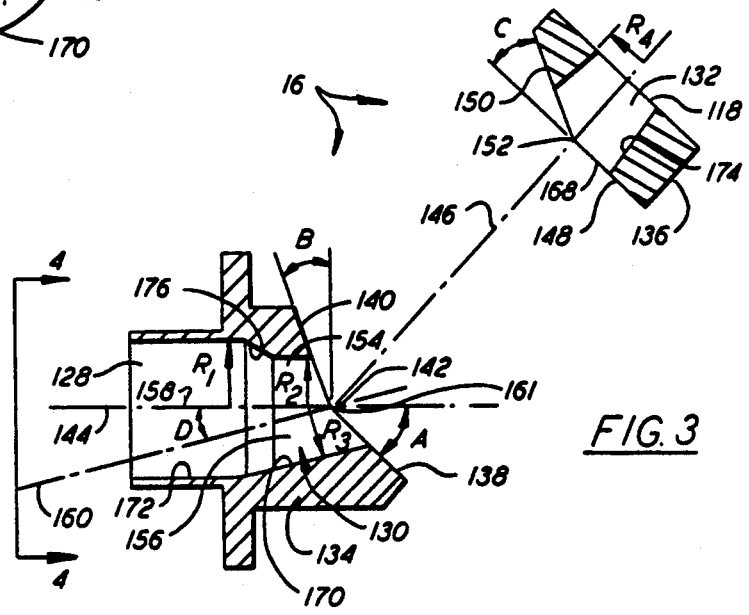
FIG. 3 is an exploded longitudinal section of the gas cap of FIG. 2.

Because of its complexity in shape, the gas cap member 16 is advantageously formed integrally from two members first formed separately as shown in the exploded view of FIG. 3. A first member 134 contains the entrance channel 128 and the intermediate channel 130, and a second member 136 contains the exit channel 132. The first member 134 has a far end face 138 angled, for the 45° gas cap, forwardly at an angle A of 45° to the entrance axis 144, and a near end face 140 angled rearwardly at an angle B of 18.5° from the normal to the axis, the two faces meeting at a corner 142 at the axis 144. A far mating face 148 for the second member 136 is normal to the exit axis 146, and a near mating face 150 is angled forwardly at an angle C of 26.5° to the normal to that axis, these faces also meeting at a corner 152 at the axis. The two members are brazed together at the faces with the corners 142,152 juxtaposed to form the unitary gas cap.

The entrance channel 128 is symmetrical on the entrance axis 144. The exit channel 132 is symmetrical on the exit axis 146 oriented at a selected angle to the entrance axis greater than zero. The selected angle should provide a sufficient sideways component to the thermal spray stream to produce a quality coating on a sidewall of a tubular workpiece or the like. The angle thus may be any angle greater than zero and generally should be from about 30° to at least 60°, e.g. 45° as shown.

Particularly according to the invention the intermediate channel 130 is asymmetrical to the axes, and symmetrical to a plane defined by the axes 144,146. Channel 130 includes a near portion 154 and a far portion 156 (FIG. 3), "near" and "far" being relative to the outlet end of the passage which is angled away from the entrance axis. As shown also in end view FIG. 4, the near channel 154 portion is generally semicylindrical about a near axis 158 contiguous to, and preferably coincidental with, the entrance axis 144.

Figure 4:
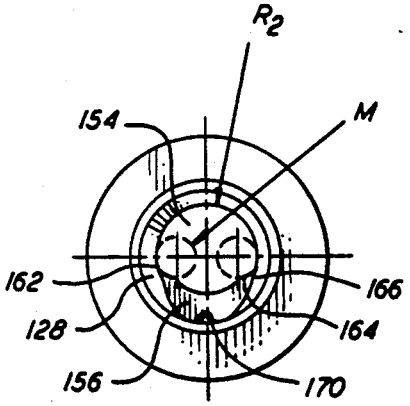
FIG. 4 is an end view of one member of the gas cap of FIG. 3.

The far portion 156 also is generally semicylindrical, about a far axis 160. This far axis is offset from the near axis 158 in a direction away from the outlet end 118 and is oriented at an intermediate angle D to the entrance axis between zero and the selected angle. Preferably the entrance axis 158, the exit axis 146 and the far axis 160 all intersect at a common point 161. A suitable angle D is 14°, or about one third of the selected angle of 45° in the present example. Broadly the intermediate angle should be between about one fifth and one half of the selected angle. In order to manufacture the gas cap with semicylindrical near and far portions in the channel it is advantageous to bore out the near portion 154 with an end mill with a diameter M slightly less than the radius $R_2$ of the near portion (FIG. 4). For example for a 5.9 mm (0.233 inch) radius $R_2$ for the near portion, an 4.75 mm (0.1875 inch) end mill is used. This results in not only substantially semicylindrical portions, but also a tighter radius M/2 in the near portion region 162 proximate the far portion. There also will be distinct boundary edges between the near portion and the far portion. Advantageously these edges are given a chamfer with an end mill to the profile 166, since otherwise some powder buildup may occur in the gas cap near the exit end 118.

The exit channel 132 should be convergingly conical toward the exit, example 7° to the axis 146 in the present example. The exit end should have an exit radius $R_4$ with a value less than the entrance radius $R_1$. The exit radius $R_4$ should be between about 50% and 75% of the entrance radius $R_1$, e g. 4.85 mm (0.191 inches) for a 7.65 mm (0.301 inches) entrance radius, i.e. 64%. The inlet 168 of the exit channel abuts the near and far portions 154,156 and is taylored in radius to match the size of the asymmetrical intermediate channel, with inherent small shoulders being tolerable.

The near portion 154 of channel 130 has a near radius $R_2$ preferably with a value between the entrance radius $R_1$ and the exit radius $R_4$, e.g. 5.9 mm (0.233 inches). The far portion 156 has a far radius $R_3$ with a value less than the near radius $R_2$ and preferably greater than the exit radius $R_4$; e.g. the far radius is 5.3 mm (0.210 inches).

The segment 170 of the wall of the far portion 156 that is distal from the near axis 158 is positioned, by cooperative selection of the various radii and relative positions of axes, so as to substantially connect with respective adjacent wall segments 172,174 of the entrance and exit channels. This provides for relatively smooth flow along the outside of the angled curve in the passage. Small steps or shoulders at the outer wall junctions, e.g. 0.5 mm in the present by sized gas cap, are again a tolerable practicality.

The entrance channel 128 of the gas cap fitted over the nozzle of the present burner head is cylindrical, preferably with a substantially constant radius $R_1$, herein denoted the entrance radius. The entrance channel may start larger and converge slightly away from the entrance end, down to the radius $R_1$. Conveniently, however, the entrance channel is cylindrical and the intermediate channel 130 further has a conically convergent portion 176 symmetrical on the entrance axis 144, thereby connecting the entrance channel to the smaller portions 154,156 (exclusive of minor variations at the distal wall segment 170 where the walls connect.)

The thermal spray gun is operated substantially as described in the aforementioned U.S. Pat. No. 4,865,252 for a high velocity spray. A supply of each of the gases to the cylindrical combustion chamber is provided at a sufficiently high pressure, e.g. at least two atmospheres above atmospheric, and is ignited conventionally such as with a spark device, such that the mixture of combusted gases and air will issue from the exit end as a supersonic flow entraining the powder. The heat of the combustion will at least heat soften the powder material such as to deposit a coating onto a substrate. Shock diamonds should be observable.

The angular gas cap of the invention can successfully deflect the spray stream to at least a 45° angle without significant erosion or powder buildup in the gas cap. High quality coatings of stainless steel have been applied to the inside of a fixed 9 cm diameter piped utilizing the rotating feature described herein.

A similar angular gas cap may be utilized on other types of thermal spray guns according to the invention, including a lower velocity powder spray gun, a wire spray gun and a plasma spray gun, respectively of the types described in the aforementioned U.S. Pat. Nos. 3,171,599, 3,122,321 and 3,707,615. Thus the term "burner head" as used broadly herein and in the claims means a combustion nozzle system as well as an arc plasma generator. The gas cap is adapted to the particular type of gun. For example in the case of a plasma gun the gas cap may be the anode, and the inner radius of the entrance channel is appropriately selected cooperatively with the central cathode. Powder injection into the spray stream may be internal (as described above) or external as for a conventional plasma gun. A further option for powder injection may be transversely into the gas cap as shown by a passage (broken lines) 202 in FIG. 1, replacing the central passage 80.

While the invention has been described above in detail with reference to specific embodiments, various changes and modifications which fall within the spirit of the invention and scope of the appended claims will become apparent to those skilled in this art. Therefore, the invention is intended only to be limited by the appended claims or their equivalents.

What is claimed is:

1. An angular gas cap for a thermal spray gun, comprising a gas cap member having a passage extending therethrough with an inlet end and an outlet end, the passage being receptive of a spray stream of a thermal spray burner head from the inlet end, wherein:

the passage includes an entrance channel extending from the inlet end, an exit channel extending to the outlet end, and an intermediate channel connecting between the entrance and exit channels;

the entrance channel is symmetrical on an entrance axis, and the exit channel is symmetrical on an exit axis oriented at a selected angle to the entrance axis greater than zero, so that the entrance axis and the exit axis define a plane; and the intermediate channel is symmetrical to the plane and has a near portion and a far portion, the near portion being generally semicylindrical about a near axis lying in the plane contiguous to the entrance axis, and the far portion being generally semicylindrical about a far axis segment, the far axis segment lying in the plane offset from the near axis in a direction away from the outlet end and being oriented at an intermediate angle to the entrance axis between zero and the selected angle.

2. The gas cap according to claim 1 wherein the near axis and the entrance axis coincide.

3. The claim according to claim 2 wherein the entrance axis, the exit axis and the far axis segment intersect at a common point.

4. The gas cap according to claim 1 wherein the far portion has a wall segment distal from the near axis and substantially connecting with adjacent wall segments of the entrance and exit channels.

5. The gas cap according to claim 1 wherein the selected angle is between about 30° and 60°.

6. The gas cap according to claim 5 wherein the intermediate angle is about one third of the selected angle.

7. The gas cap according to claim 6 wherein the entrance channel is substantially cylindrical with an entrance radius defined adjacent to the intermediate channel, the exit channel is convergingly conical toward the outlet end, and the outlet end has an exit radius with a value less than the entrance radius.

8. The gas cap according to claim 7 wherein the exit radius is between about 50% and 75% of the entrance radius.

9. The gas cap according to claim 1 wherein the intermediate angle is between about one fifth and one half of the selected angle.

10. The gas cap according to claim 1 wherein boundary edges between the near portion and the far portion are chamfered.

11. The gas cap according to claim 10 wherein the near portion has a near radius with a value between the entrance radius and the exit radius, and the far portion has a far radius with a value between the near radius and the exit radius.

12. The gas cap according to claim 11 wherein the intermediate channel further has a conically convergent portion symmetrical on the entrance axis connecting from the entrance channel to the near and far portions.

13. The gas cap according to claim 1 wherein the gas cap member is formed integrally of a first member and a second member, the first member having the entrance channel and the intermediate channel, and the second member having the exit channel.

14. An angular gas cap for a thermal spray gun, comprising a gas cap member having a passage extending therethrough with an inlet end and an outlet end, the passage being receptive of a spray stream of a thermal spray burner head from the inlet end, wherein:

the passage includes an entrance channel extending from the inlet end, an exit channel extending to the outlet end, and an intermediate channel connecting between the entrance and exit channels;

the entrance channel is substantially cylindrical on an entrance axis and has an entrance radius defined adjacent the intermediate channel, and the exit channel is convergingly conical toward the outlet end on an exit axis oriented at a selected angle to the entrance axis between about 30° and 60° so that the entrance axis and the exit axis define a plane, the exit end having an exit radius between about 50% and 75% of the entrance radius; and the intermediate channel is symmetrical to the plane and has a near portion, a far portion and a conically convergent portion symmetrical on the entrance axis connecting from the entrance channel to the near and far portions; the near portion being generally semicylindrical about the entrance axis and having a near radius with a value between the entrance radius and the exit radius, and the far portion being generally semicylindrical about a far axis segment and having a far radius with a value between the near radius and the exit radius, the far axis segment lying in the plane offset from the near axis in a direction away from the outlet end and being oriented at an intermediate angle to the entrance axis between about one fifth and one half of the selected angle, the far portion further having a wall segment distal from the near axis and substantially connecting with adjacent wall segments of the entrance and exit channels, with boundary edges between the near portion and the far portion being chamfered.

15. The gas cap according to claim 14 wherein the selected angle is about 45°.

16. A thermal spray gun comprising a burner head for generating a spray stream, and a gas cap mounted on the burner head and having a passage extending therethrough with an inlet end and an outlet end such that the passage is receptive of the spray stream from the inlet end, wherein:

the passage includes an entrance channel extending from the inlet end, an exit channel extending to the outlet end, and an intermediate channel connecting between the entrance and exit channels;

the entrance channel is symmetrical on an entrance axis, and the exit channel is symmetrical on an exit axis oriented at a selected angle to the entrance axis greater than zero, so that the entrance axis and the exit axis define a plane; and the intermediate channel is symmetrical to the plane and has a near portion and a far portion, the near portion being generally semicylindrical about a near axis lying in the plane contiguous to the entrance axis, and the far portion being generally semicylindrical about a far axis segment, the far axis segment lying in the plane offset from the near axis in a direction away from the outlet end and being oriented at an intermediate angle to the entrance axis between zero and the selected angle.

17. The thermal spray gun according to claim 16 wherein the near axis and the entrance axis coincide, the burner head comprises a nozzle member with a nozzle face, the nozzle member extends coaxially through the entrance channel into the intermediate channel, the intermediate and exit channels define a combustion chamber bounded by the nozzle face, and the thermal spray gun further comprises combustible gas means for injecting an annular flow of a combustible mixture of a combustion gas and oxygen from the nozzle member coaxially in to the combustion chamber at a pressure therein of at least two bar above atmospheric pressure, outer gas means for injecting an annular outer flow of pressurized non-combustible gas through the entrance channel outwardly of the nozzle member into the combustion chamber, and feeding means for feeding head fusible thermal spray powder in a carrier gas coaxially from the nozzle member into the combustion chamber proximate the entrance axis, such that, with a combusting of the combustible mixture, a supersonic spray stream containing the heat fusible material in finely divided form is propelled through the outlet end.

18. The thermal spray gun according to claim 17 further comprising inner gas means for injecting an annular inner flow of pressurized gas from the nozzle member into the combustion chamber coaxially between the combustible mixture and the powder-carrier gas.

19. The thermal spray gun according to claim 16 wherein the selected angle is between about 30° and 60°, the intermediate angle is between about one fifth and one half of the selected angle, the far portion has a wall segment distal from the near axis and substantially connecting with adjacent wall segments of the entrance and exit channels, boundary edges between the near portion and the far portion are chamfered, the exit channel is convergingly conical toward the outlet end, the entrance channel has an entrance radius adjacent the intermediate channel and the outlet end has an exit radius with a value between about 50% and 75% of the entrance radius, the near portion has a near radius with a value between the entrance radius and the exit radius, the far portion has a far radius with a value between the near radius and the exit radius, and the intermediate channel further has a conically convergent portion symmetrical on the entrance axis connecting from the entrance channel to the near and far portions exclusive of the distal wall segment.

20. The thermal spray gun according to claim 16 wherein the nozzle member has an outer wall extending coaxially through the entrance channel into the intermediate channel, the outer wall being terminated by a convergingly beveled wall section encompassing the nozzle face.

21. The thermal spray gun according to claim 20 wherein the nozzle member is disposed with the beveled wall section located axially about half way along the distal wall segment of the far portion.

* * * * *